US005271310A

United States Patent [19]

Muller

[11] Patent Number: 5,271,310

[45] Date of Patent: Dec. 21, 1993

[54] APPARATUS FOR INFEEDING CARTRIDGES OF TWO DIFFERENT TYPES OF AMMUNITION TO A GATLING-TYPE GUN

[75] Inventor: Kurt Muller, Zurich, Switzerland

[73] Assignee: Oerlikon-Contraves AG, Zurich, Switzerland

[21] Appl. No.: 921,043

[22] Filed: Jul. 28, 1992

[30] Foreign Application Priority Data

Aug. 30, 1991 [CH] Switzerland ..... 02551/91

[51] Int. Cl.[5] ..... F41A 9/34; F41A 9/35

[52] U.S. Cl. ..... 89/33.04; 89/33.16; 89/33.5

[58] Field of Search ..... 89/45, 46, 33.04, 33.4, 89/33.14, 33.16, 33.1, 33.17, 34, 33.5

[56] References Cited

U.S. PATENT DOCUMENTS

| | | | |
|---|---|---|---|
| 4,253,376 | 3/1981 | Washburn et al. | 89/34 |
| 4,434,699 | 3/1984 | Tassie | 89/12 |
| 4,765,223 | 8/1988 | Beckmann | 89/33.04 |
| 5,115,713 | 5/1992 | Muller et al. | 89/33.14 |
| 5,115,714 | 5/1992 | Muller et al. | 89/33.16 |

FOREIGN PATENT DOCUMENTS

| | | |
|---|---|---|
| 0020095 | 12/1980 | European Pat. Off. . |
| 0403776 | 12/1990 | European Pat. Off. . |
| 3040798 | 9/1981 | Fed. Rep. of Germany . |
| 3202841 | 8/1982 | Fed. Rep. of Germany . |
| 3219800 | 12/1983 | Fed. Rep. of Germany . |
| 3211416 | 10/1985 | Fed. Rep. of Germany . |

*Primary Examiner*—Stephen M. Johnson

*Attorney, Agent, or Firm*—Sandler Greenblum & Bernstein

[57] ABSTRACT

Apparatuses for the infeed of cartridges predominantly of two different types of ammunition from conveying devices to a Gatling-type gun or weapon system, can be constructed such that first and second transport devices, a third device and the Gatling-type gun can be simultaneously driven if there are provided storage devices for the intermediate storage of the empty cases during reverse clearing following a firing burst. These storage devices are operatively associated with conveying devices from which the Gatling-type gun has delivered ammunition thereto by the first and second transport devices. The conveying devices, which deliver cartridges from ammunition magazines, can be selectively driven. There is prevented transport of empty cases during reverse clearing by the Gatling-type gun and there is attained the result that the Gatling-type gun is free of empty cases prior to accomplishing a new firing burst. Additionally, it is possible to fire cartridges or ammunition rounds of one type of ammunition from two ammunition magazines without the need to exchange one of the ammunition magazines.

5 Claims, 11 Drawing Sheets

APPARATUS FOR INFEEDING CARTRIDGES OF TWO DIFFERENT TYPES OF AMMUNITION TO A GATLING-TYPE GUN

CROSS REFERENCE TO RELATED APPLICATION

This application is related to the commonly assigned, copending U.S. application Ser. No. 07/913,199, filed Jul. 14, 1992 and entitled "Apparatus For Infeeding Cartridges of Two Different Types of Ammunition to a Gatling-Type Gun", to which reference may be readily had and the disclosure of which is incorporated herein in its entirety by reference.

BACKGROUND OF THE INVENTION

1. Field of the Invention

The present invention relates to a new and improved apparatus for the infeed of cartridges predominantly or generally composed of two different types of ammunition to a Gatling-type gun or weapon system.

Generally speaking, the inventive apparatus for the infeed or feed of cartridges or ammunition rounds predominantly composed of two different types of ammunition to a Gatling-type gun or weapon system is of the type comprising two ammunition magazines each provided with a respective conveying device. A first transport device and a second transport device serve for the transport of cartridges and empty cases or spent cartridges predominantly composed of a respective type of ammunition. A third device provided with guide devices and which is arranged between the first transport device and the second transport device and in coacting relation with the Gatling-type gun serves for infeeding the cartridges of one ammunition type or the other ammunition type to the Gatling-type gun.

2. Discussion of the Background and Material Information

With an ammunition infeeding apparatus of the aforementioned type, hereinafter also conveniently referred to as a double or twin ammunition infeeding apparatus, such apparatus is of the type wherein two different types of ammunition can be selectively delivered to a Gatling-type gun or weapon system. As a result, it is possible to change the type of ammunition or rounds which are to be fired between the firing bursts or surges.

Double or twin ammunition infeeding apparatuses of the aforementioned type are known, for example, from U.S. Pat. No. 4,434,699, granted Mar. 6, 1984 and the cognate German Patent No. 3,040,798, dated Sep. 3, 1981. In such apparatus two endless transport devices, which serve for the infeed of ammunition, are displaceably arranged in relation to a third device. If there is switched over from one type of ammunition to another type of ammunition, then both of the endless transport devices are mechanically shifted, and in each case a gear of one of the endless transport devices meshes with a gear of the third device. Since there is provided a drive source which not only drives the Gatling-type gun but also the third device, with this solution there is also selectively conjointly driven either one or the other of the endless transport devices, and thus, there is delivered the one or the other type of ammunition to the Gatling-type gun. However, following reverse clearing or repositioning after a firing burst with one type of ammunition, empty cases or spent cartridges remain both in the Gatling-type gun and also in the third device. It is here pointed out that in the context of this disclosure, the term "reverse clearing" or "repositioning" means the return movement of the Gatling-type gun, the third device and the endless transport device, in order to re-establish a preparatory firing state or condition. During the reverse clearing or repositioning operation the cartridges are transported in the opposite direction by the Gatling-type gun, the third device and the endless transport device, however are not fired. During the next firing burst with the other type of ammunition, the remaining empty cases or spent cartridges in the Gatling-type gun and in the third device arrive at the other endless transport device. With this solution the bucket chains in the ammunition magazines are filled without empty places or positions with cartridges and/or with empty cases.

A further proposal is known to the art from German Published Patent Application No. 3,202,841, published Aug. 19, 1982. Also in this document there is disclosed a Gatling-type gun provided with an infeed apparatus for the infeed of two different types of ammunition. This ammunition infeed apparatus possesses two endless stationary transport devices for the infeed or delivery of two different types of ammunition and either one or the other of both endless transport devices is selectively switched-in or activated. Furthermore, a third device is provided for the reception and infeed of cartridges from and to the breechblocks. However, with this proposal empty cases or spent cartridges are not removed by means of the endless transport devices, rather by an additional channel.

Furthermore, an ammunition storage apparatus for a simple infeed arrangement to a rapid firing weapon and to stationary multi-barrel weapons is disclosed in European Published Patent Application No. 0,020,095, published Dec. 10, 1980 and the cognate U.S. Pat. No. 4,253,376, granted Mar. 3, 1981. The empty cases or spent cartridges, during reverse clearing or repositioning, are intermediately stored in the storage apparatus. As a result, there is prevented the return of the spent cartridges to the breechblocks and the ammunition chambers. With this solution the bucket chains in the ammunition magazines are filled without empty places or positions with cartridges and/or with empty cases. However, with this arrangement the storage apparatus is part of the transport apparatus used for the transport of cartridges to the weapon and empty cases or spent cartridges from the weapon.

SUMMARY OF THE INVENTION

Therefore, with the foregoing in mind, it is a primary object of the present invention to provide an improved apparatus for the infeed of cartridges generally composed of two different types of ammunition to a Gatling-type gun or weapon system, which is not afflicted with the aforementioned shortcomings and drawbacks of the prior art.

Another and more specific object of the present invention aims at the provision of an ammunition infeed apparatus which simplifies the infeed of cartridges composed of two different types of ammunition to a Gatling-type gun and during reverse clearing precludes the transport of empty cases by the third device and the Gatling-type gun.

Now in order to implement these and still further objects of the present invention, which will become more readily apparent as the description proceeds, the apparatus of the present development for the infeed of cartridges predominantly or generally composed of two different types of ammunition to a Gatling-type gun or weapon system is manifested, among other things, by the features that the first transport device, the second transport device and the third device are simultaneously driven. In other words, there are provided drive means for thusly driving the first and second transport devices and the third device. A respective storage device is operatively associated with a respective one of the conveying devices, these storage devices serving for the reception of empty cases or spent cartridges from the associated conveying device during reverse clearing following a firing burst, in order to ensure that prior to a new firing burst both the Gatling-type gun, the third device and the first and second transport devices are free or devoid of empty cases. Moreover, the conveying devices are selectively drivable.

According to a further aspect of the present invention, each of the storage devices is operatively associated with a respective sensor or feeler and a respective switching gate or switch.

Still further, the guide devices of the third device are constructed to be switchable, that is, define switchable guide devices, in order to operatively interconnect the transport devices and the third device, so that only cartridges of a single ammunition type can be delivered to the Gatling-type gun.

One of the more notable advantages of the present invention resides in the fact that both of the transport devices, the third device and the Gatling-type gun can be simultaneously driven. Consequently, the construction is simplified at the location or region of both of the transport devices and the third device.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, it is to be understood that only enough of the construction of the apparatus for the infeed of cartridges predominantly or generally composed of two different types of ammunition to a Gatling-type gun or weapon system has been depicted therein, in order to simplify the illustration, as needed for those skilled in the art to readily understand the underlying principles and concepts of the present invention.

Figure 1:
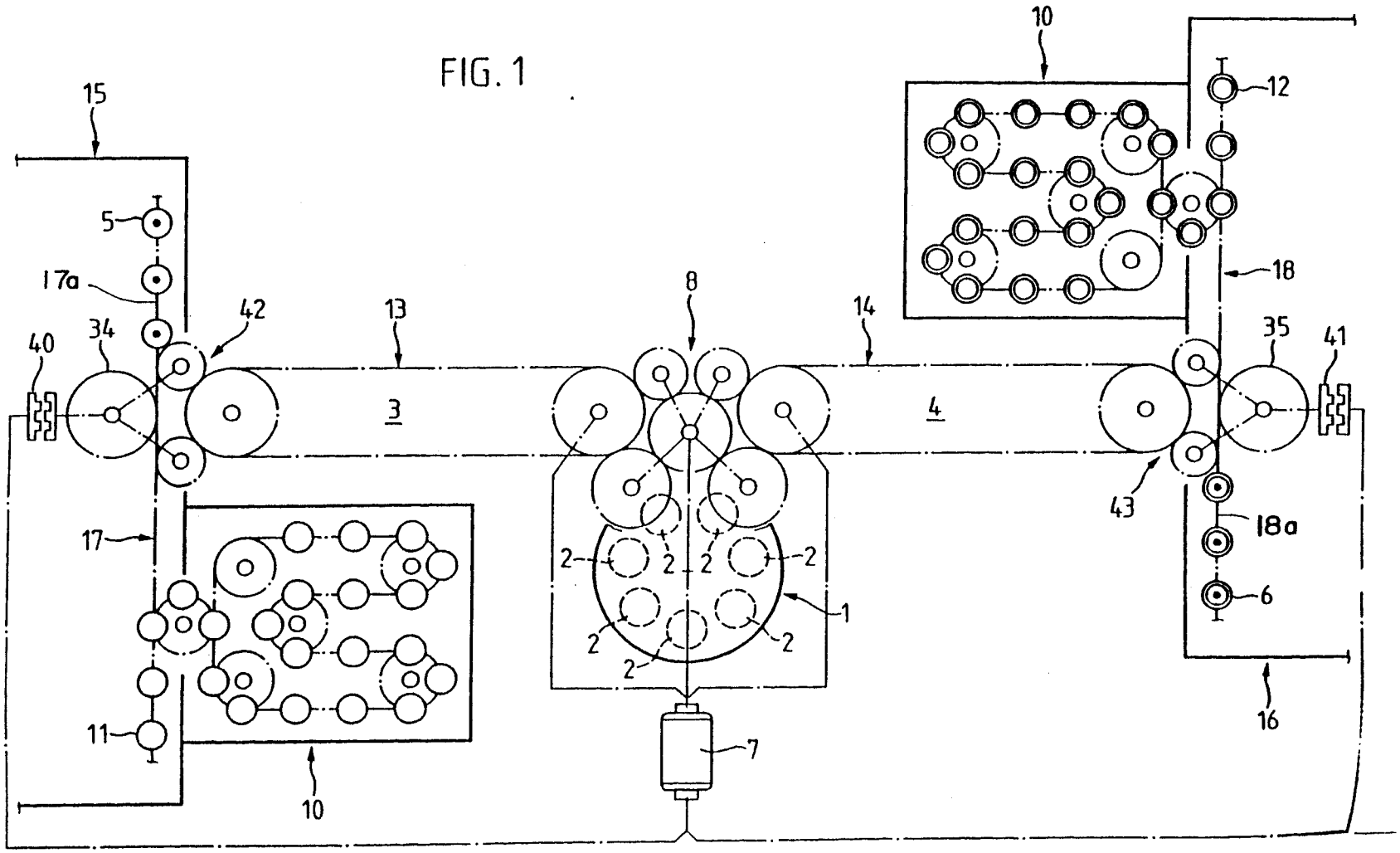
FIG. 1 is a simplified schematic illustration of an inventive double or twin ammunition infeeding or feed apparatus for infeeding ammunition to a Gatling-type gun.

Turning attention now to FIG. 1, there is depicted therein a suitable Gatling-type gun 1 containing a number of breechblocks or breech mechanisms 2, with which there is operatively associated an apparatus for the infeed of cartridges or ammunition rounds 5 or 6 of the ammunition types A or B. As will be recalled, such ammunition infeed or feed apparatus is also sometimes referred to herein as a double or twin ammunition infeeding apparatus. This double or twin ammunition infeeding apparatus comprises a first transport device 3 and a second transport device 4 for the transport of the cartridges or ammunition rounds 5 of ammunition type A and the cartridges or ammunition rounds 6 of ammunition type B, respectively. The cartridges 5 and 6 are stored in two merely schematically indicated ammunition magazines or containers 15 and 16, respectively, and by means of a respective conveying device 17 and 18, for example, endless bucket chains 17*a* and 18*a*, are transferred at transfer locations 42 and 43 to the associated transport devices 3 and 4, respectively. These transport devices 3 and 4 advantageously constitute endless transport devices.

Additionally, there is provided a third device 8 shown located between the first and second transport devices or endless transport devices 3 and 4. This third device 8 serves for the take-up and delivery of cartridges or ammunition rounds 5 or 6 of the respective ammunition type A or B from and to the breechblocks 2. Still further, there is provided a suitable drive source or drive means 7 for simultaneously driving the Gatling-type gun 1, the third device 8, the first transport device 3 and the second transport device 4. The conveying devices 17 and 18 are selectively driven by means of suitable couplings 40 and 41 or equivalent structure and transport wheels 34 and 35 likewise from the driving source or drive means 7. Moreover, a respective storage device 10 is provided for each bucket chain 17*a* and 18*a* and which serve for the reception or take-up of empty cases or spent cartridges 11 or 12 of the ammunition type A or B during reverse clearing or repositioning following a firing burst. These storage devices 10 ensure that both the Gatling-type gun 1 and also the third device 8 as well as both transport devices 3 and 4 are devoid of empty cases or spent cartridges 11 or 12 prior to carrying out a new firing burst.

Figure 2:
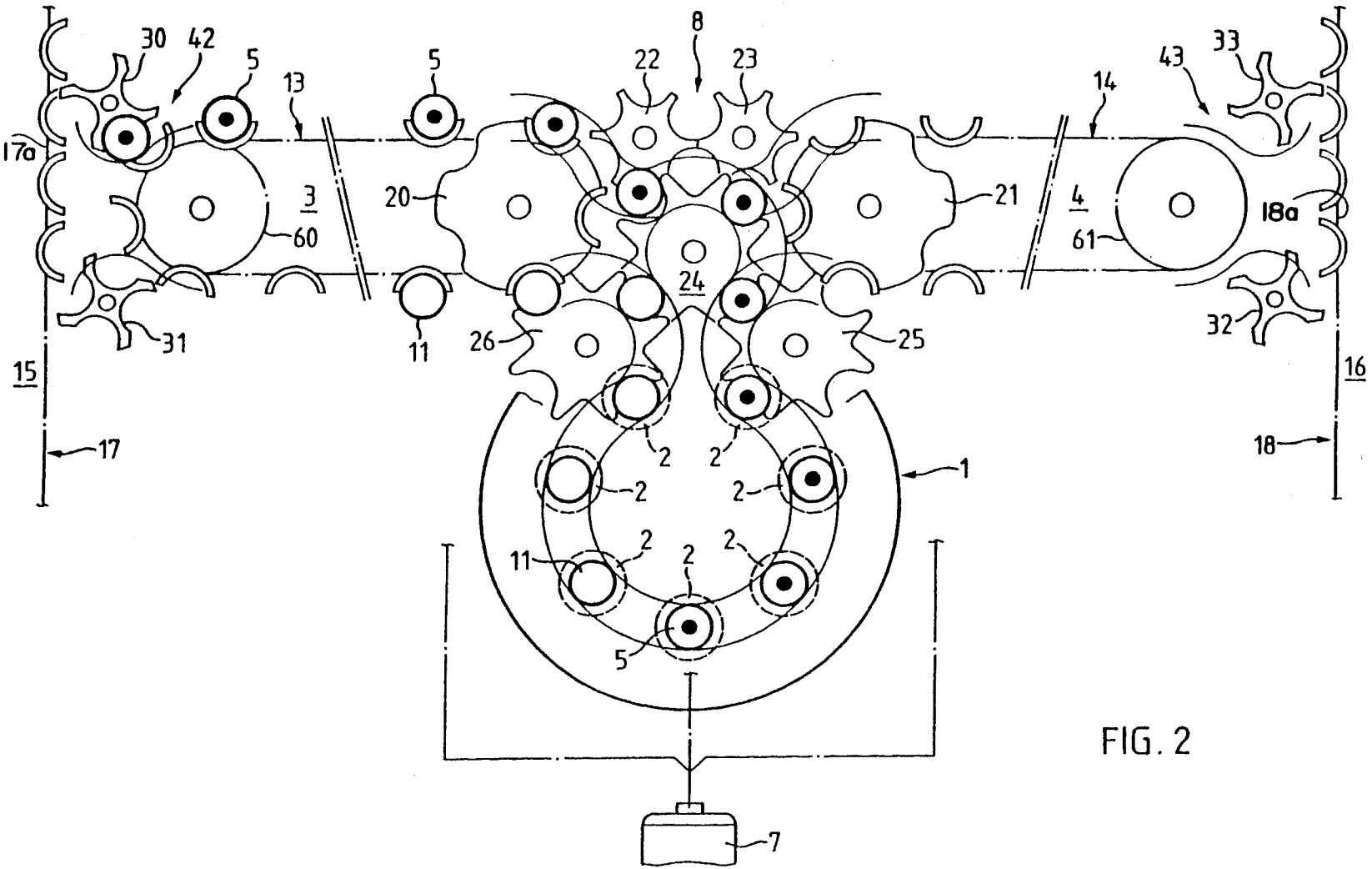
FIG. 2 is a fragmentary and enlarged detail view of part of the double or twin ammunition infeeding apparatus of FIG. 1.

FIG. 2 illustrates part of the double or twin ammunition infeeding apparatus while here assuming, solely by way of explanation and not limitation, that there are fired cartridges or ammunition rounds 5 of the ammunition type A furnished by the ammunition magazine 15. These cartridges 5 of the ammunition type A are transferred by the conveying device 17 of the ammunition magazine 15 by means of a first transfer star wheel 30 and a transport wheel 60 to transfer location 42 of the first transport device 3, and then, delivered by an endless bucket chain 13 of the first transport device 3 and a transport wheel 20 or equivalent structure to the third device 8. In this third device 8 the cartridges 5 are transferred to a central deflection or turning wheel 24 and with the aid of deflection or turning wheels 22, 23 and 25 these cartridges 5 are further conveyed or transported to the breechblocks 2 of the Gatling-type gun 1. After firing of the cartridges or ammunition rounds 5 the empty cases or spent cartridges 11 are returned by the Gatling-type gun 1 to the third device 8. During such time as the empty cases or spent cartridges 11 are guided by the central deflection or turning wheel 24 and a deflection or turning wheel 26, these empty cases or spent cartridges 11 are again returned by means of the transport wheel 20, the bucket chain 13, the transport wheel 60 and the second transfer star wheel 31 to the transfer location 42 of the conveying device 17 of the ammunition magazine 15.

The Gatling-type gun 1, the third device 8 as well as the first endless transport device 3 and the second endless transport device 4 are simultaneously driven by the drive source or drive means 7 by means of here not particularly shown but conventional gearing or transmission means, that is to say, there are not used any couplings for this purpose. According to the showing of FIG. 1, the conveying devices 17 and 18 can be selectively driven by means of the drive source or drive means 7 via couplings 40 and 41 or equivalent structure. In accordance with the foregoing description the coupling 40 is activated and therefore, the conveying device 17 is driven. As a result, cartridges 5 of the ammunition type A are infed to the Gatling-type gun 1 and, as indicated, in corresponding manner empty cases or spent cartridges 11 are transported back to the conveying device 17.

Figure 7:
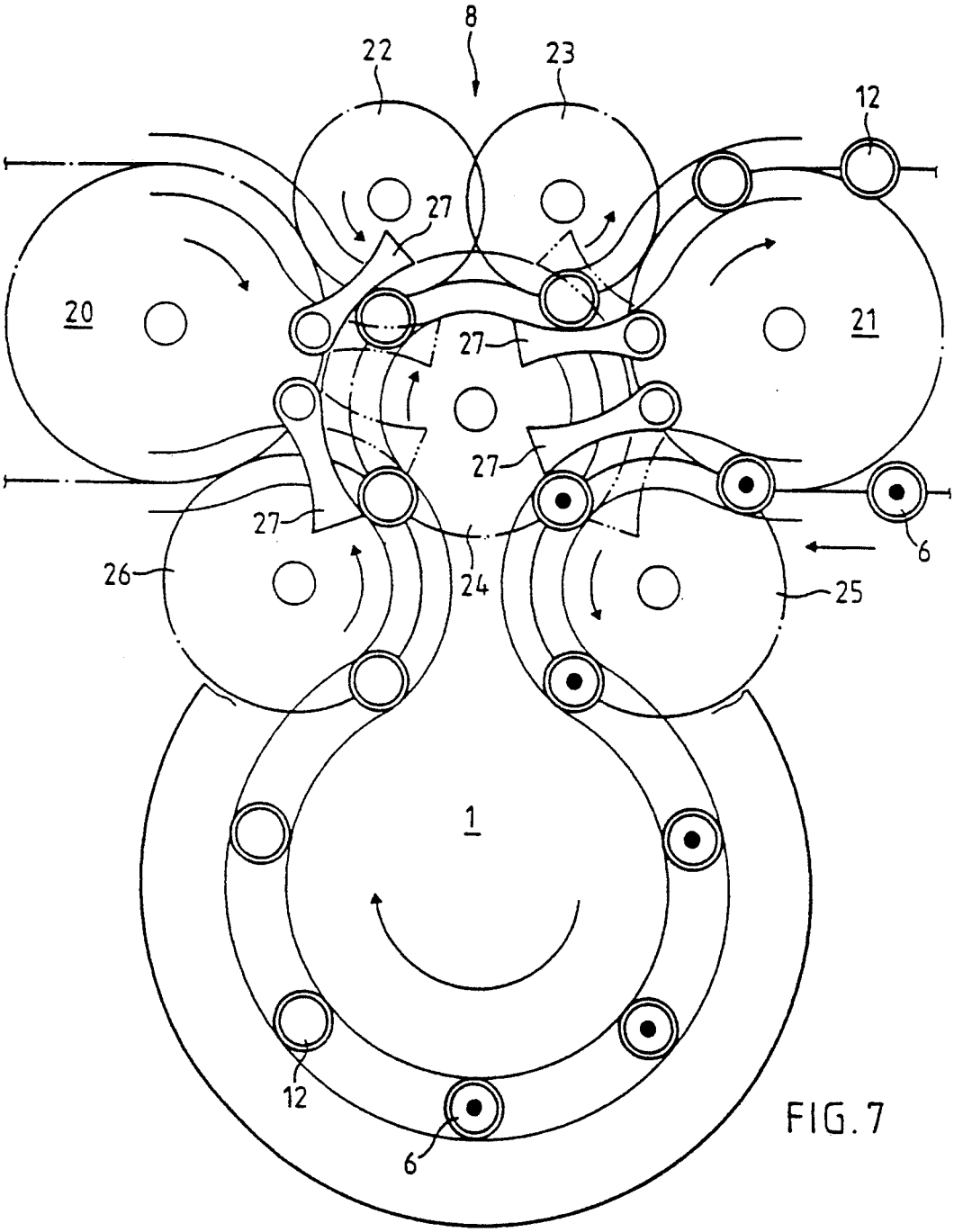
FIG. 7 depicts the guiding of ammunition and the position of the guide devices during firing cartridges of another type of ammunition, conveniently referred to as ammunition type B.

Regarding the portrayal of the infeed of cartridges or ammunition rounds 6 of the ammunition type B from the other or second ammunition magazine or container 16 in the event such should be fired, attention is directed to FIG. 7. Analogous to the first transport device 3 it will be seen that the second transport device 4 comprises transport wheels 21 and 61 and an endless bucket chain 14. Likewise analogous to the first transport device 3 it will be further seen that the other or second ammunition magazine 16 comprises the conveying device 18 and also transfer star wheels 32 and 33 at the transfer location 43 leading to the second transport device 4.

Figure 3:
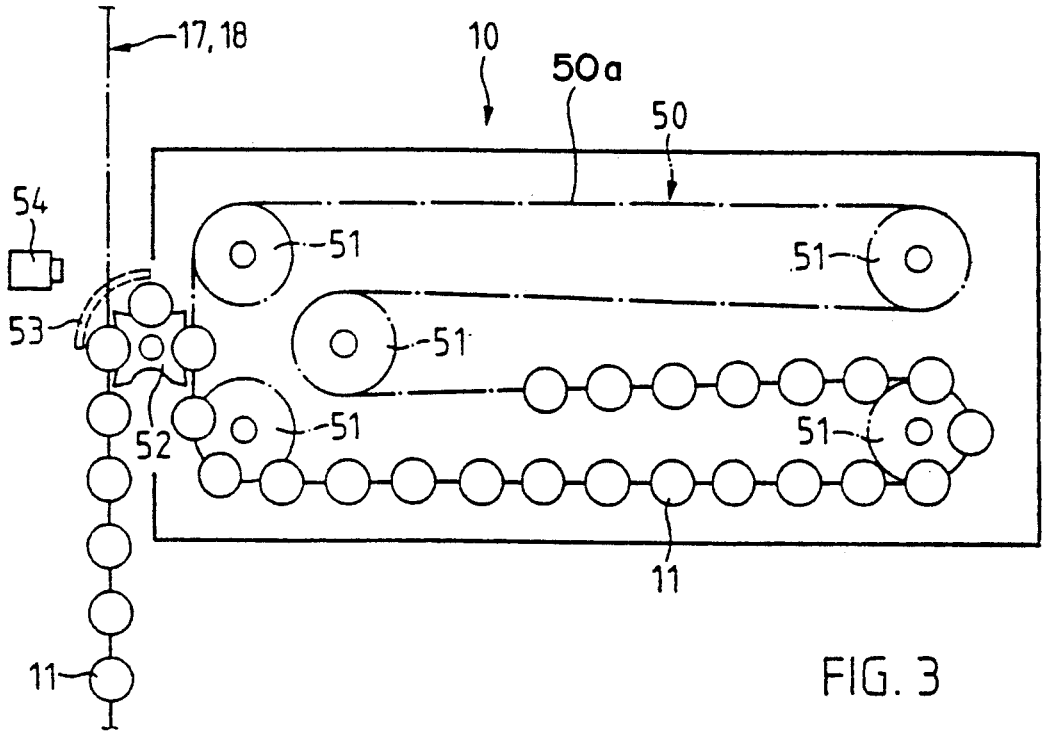
FIG. 3 is a fragmentary and enlarged detail view of a storage apparatus used in the double or twin ammunition infeeding apparatus of FIG. 1.

FIG. 3 illustrates one of the two storage devices 10 with each of which there is respectively operatively associated the first conveying device 17 and the second conveying device 18. Although the following description conveniently relates to the first ammunition magazine or container 15 it is to be expressly understood such is analogously applicable to the other or second ammunition magazine or container 16. In the depicted arrangement the storage device 10 is portrayed in that position which it assumes prior to firing or releasing a new firing burst with cartridges or ammunition rounds 5 of the ammunition type A, that is, after reverse clearing or repositioning has taken place. The storage device 10 comprises a transport device 50 containing an endless bucket chain 50*a* which revolvingly travels upon transport wheels 51. The drive of the storage device 10 is here not depicted, however occurs simultaneous with the here associated conveying device 17. This storage device 10 is arranged such that during reverse clearing such storage device 10 can take-over or receive empty cases or spent cartridges 11 from the conveying device 17 via a transfer star wheel 52. Such reception of the empty cases or spent cartridges 11 in the storage device 10 only takes place during reverse clearing. The operation is controlled by a sensor or feeler 54, by a sensor or feeler 55 (see FIG. 4*d*) and switching gate or switch 53. During a firing burst, in other words, during the forward travel of the Gatling-type gun 1, the empty cases or spent cartridges 11 are then again displaced out of the storage device 10 and again transferred by means of the transfer star wheel 52 to the conveying device 17.

FIGS. 4*a*, 4*b*, 4*c* and 4*d* depict the different phases of the operation or function of the inventive double or twin ammunition infeeding apparatus during a firing burst with cartridges or ammunition rounds 5 of the ammunition type A. The following description is equally analogously applicable during a firing burst with cartridges or ammunition rounds 6 of the ammunition type B, wherefore it is thought unnecessary to further depict the corresponding operational phases.

Figure 4A:
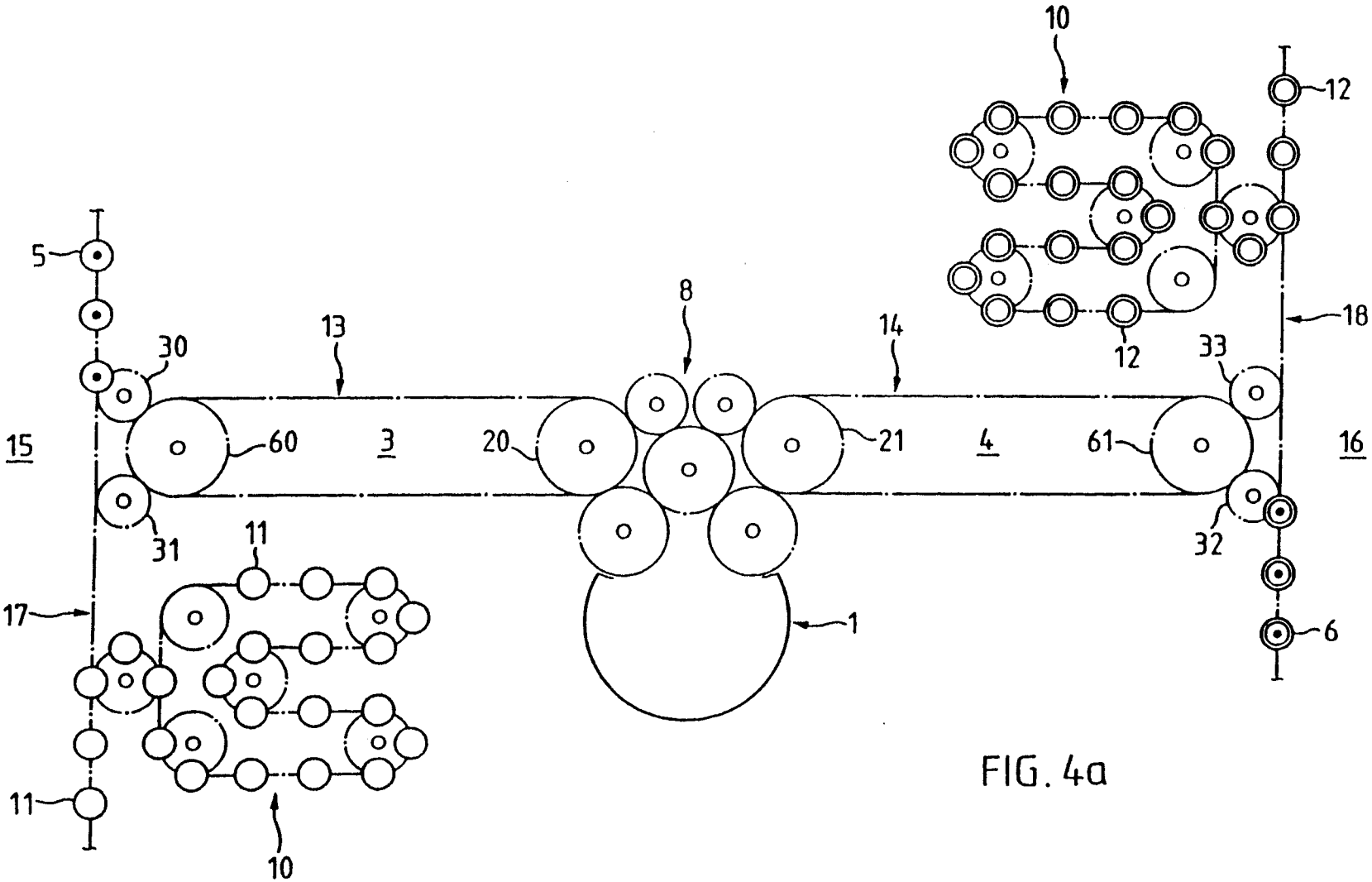
FIGS. 4*a*, 4*b*, 4*c* and 4*d* depict different phases of the function of the inventive double or twin ammunition infeeding apparatus for infeeding ammunition to a Gatling-type gun during a firing burst or surge.

FIG. 4*a* schematically depicts the situation which is designated as the firing preparatory position. Such occurs when there has been completed the reverse clearing operation. Both endless transport devices 3 and 4 as well as the third device 8 and the Gatling-type gun 1 are free or devoid of cartridges 5 and 6 or empty cases or spent cartridges 11 and 12. Cartridges or ammunition rounds 5 of the ammunition type A are located upon the conveying device 17 of the first ammunition magazine 15. The forwardmost or lead cartridge 5, in other words, that cartridge or ammunition round which is initially fired during the next following firing burst, is already located at the transport wheel 30. In this position there has been stopped by means of the sensor or feeler 55 (see FIG. 4*d*) the reverse clearing operation after the last firing burst with cartridges or ammunition rounds 5 of the ammunition type A. In this case there are likewise located at the first conveying device 17 of the first ammunition magazine 15, but also in the storage device 10 operatively associated with the conveying device 17, empty cases or spent cartridges 11 of the ammunition type A. In this position the Gatling-type gun is ready to perform a firing burst with cartridges or ammunition rounds 5 or with cartridges or ammunition rounds 6 of the ammunition type A or ammunition type B, respectively.

Figure 4B:
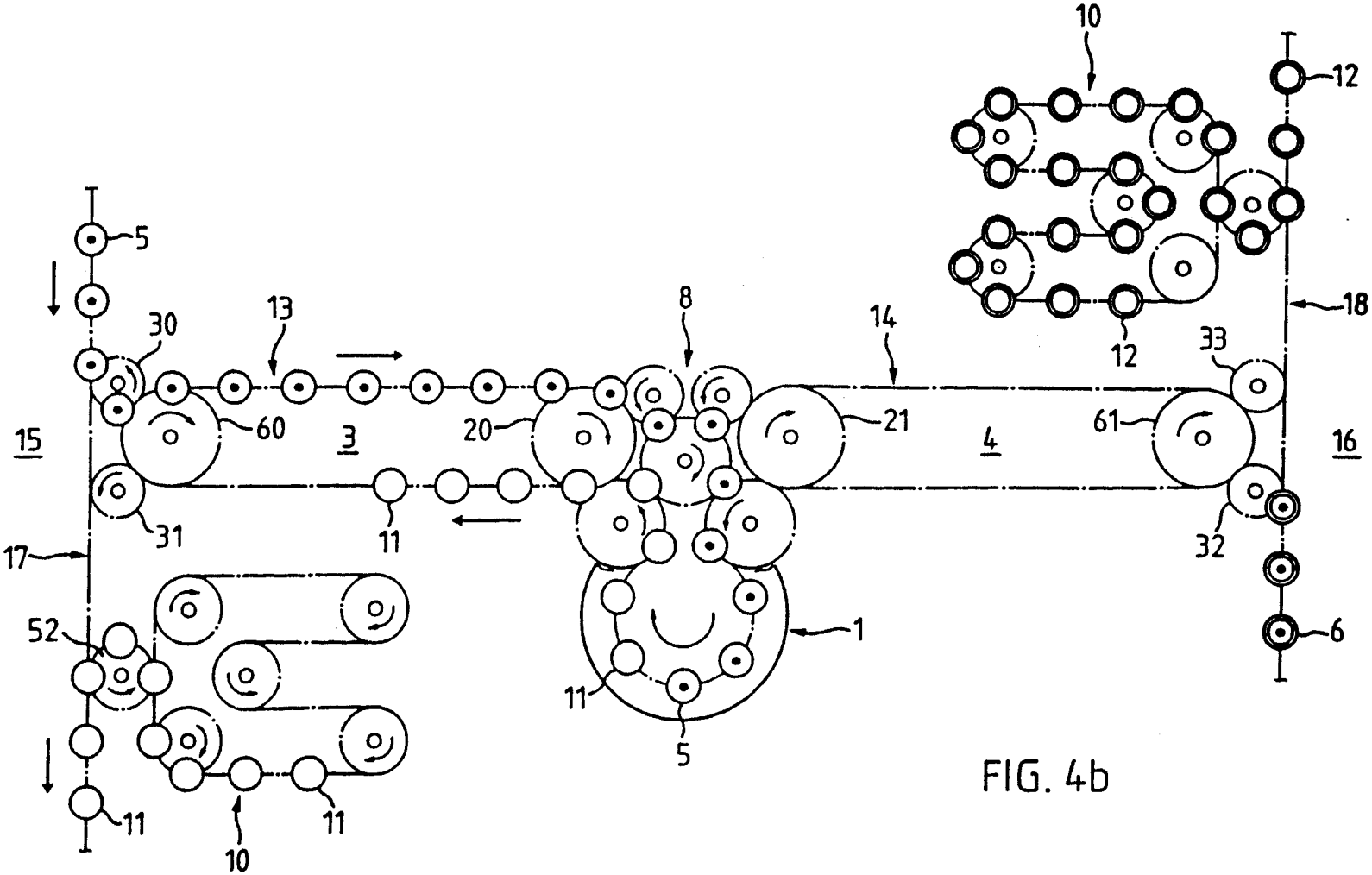

FIG. 4*b* schematically depicts the situation which arises shortly after the start of a firing burst with cartridges or ammunition rounds 5 of ammunition type A. In order to initiate a firing burst, the conveying device 17 of the first ammunition magazine 15, the first and second transport devices 3 and 4, the third device 8, the Gatling-type gun 1 and the storage device 10 operatively associated with the first conveying device 17, are placed in motion in the direction of the indicated arrows. Cartridges 5 of ammunition type A are transferred from the first conveying device 17 to the first transport device 3 and to the third device 8 which, in turn, transfers such cartridges 5 to the Gatling-type gun 1. The cartridges or ammunition rounds 5 are continuously fired and the empty cases or spent cartridges 11 are transported back to the first transport device 3 by means of the Gatling-type gun 1 and the third device 8. The first transport device 3 transports back these empty cases or spent cartridges 11 to the conveying device 17. Simultaneous with the start of driving of the conveying device 17 there is also driven the storage device 10 which has started to return the empty cases or spent cartridges 11, which have been intermediately stored thereat during the last reverse clearing or repositioning operation, by means of the transfer star wheel 52 to the conveying device 17. When the last empty case or spent cartridge 11 has been returned from the storage device 10 to the conveying device 17, then the first empty case or spent cartridge 11 of the firing burst which is in progress will join or merge thereat without any empty place or position at the conveying device 17.

Figure 4C:
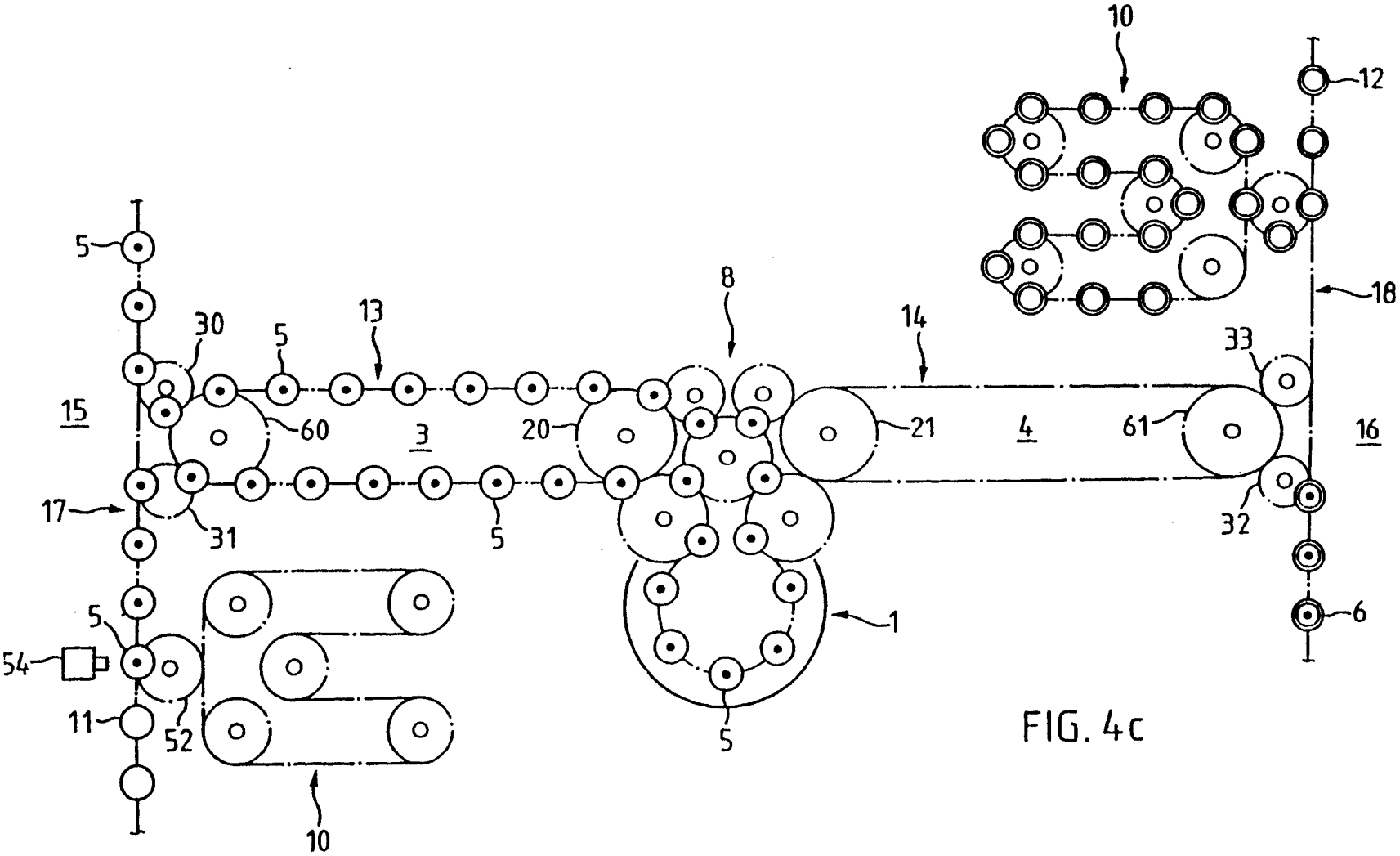

FIG. 4*c* schematically depicts the situation which arises after the termination of a firing burst with cartridges or ammunition rounds 5 of the ammunition type A and after the timewise shifted standstill of the installation. After firing the last cartridge 5 of a firing burst, the devices 1, 3, 4, 8, 10 and 17 do not immediately come to rest or standstill, rather are braked or decelerated during a certain time interval. As a result, cartridges or ammunition rounds 5 of the ammunition type A which have not been fired are further transported by the Gatling-type gun 1 and again transferred to the first transport device 3 and to the conveying device 17 of the first ammunition magazine 15. At the conveying device 17 such non-fired cartridges 5 are further transported up to a location which is situated directly in front of the transfer star wheel 52 of the storage device 10. The run-out operation or deceleration is thus stopped exactly then when the sensor or feeler 54 detects the first cartridge or ammunition round 5 which has not been fired. Thereafter, upon standstill of the installation there is switched the switching gate or switch 53 (see FIG. 4*d*) of the storage device 10 and thereafter there is initiated the reverse clearing or repositioning operation.

Figure 4D:
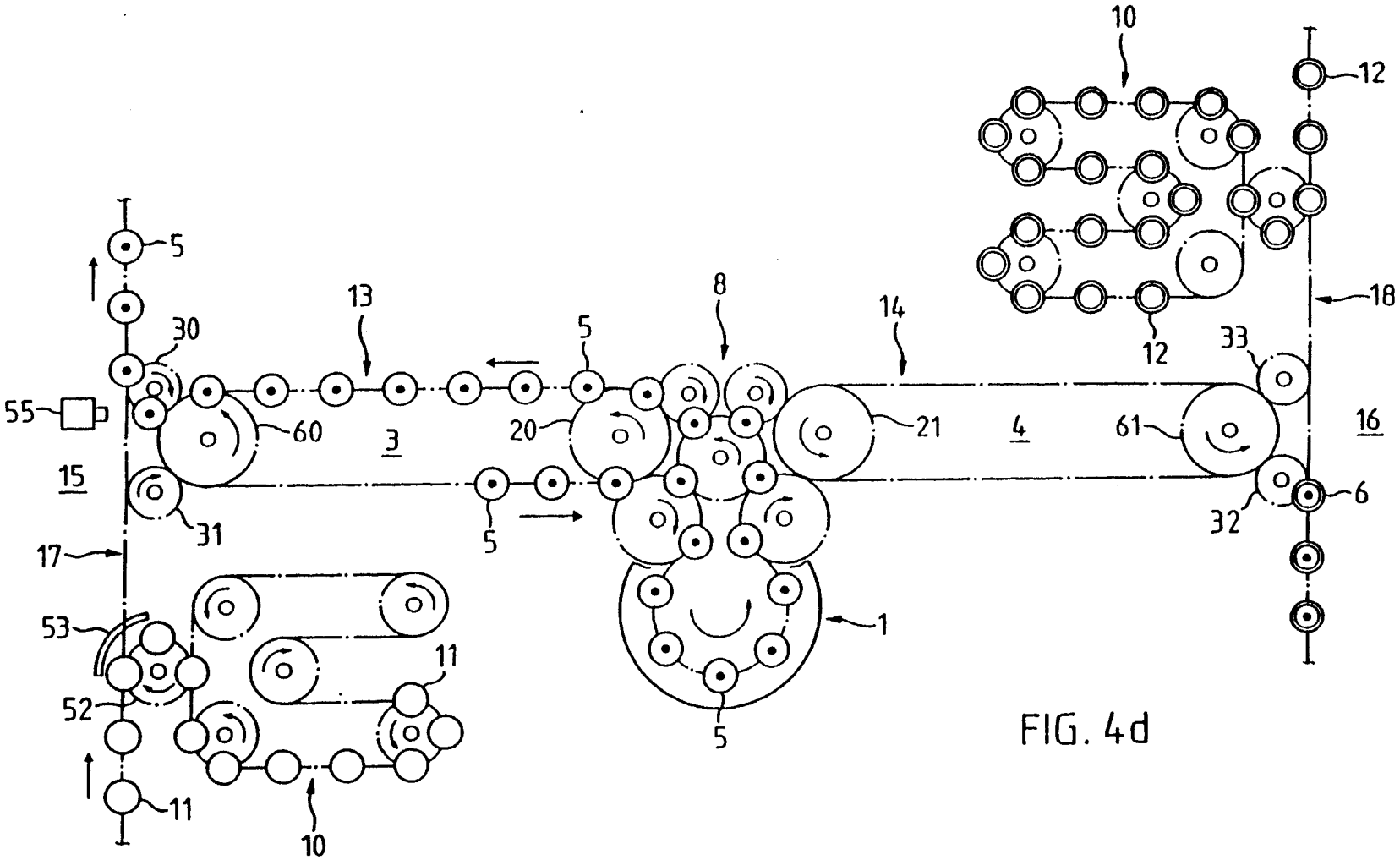

FIG. 4*d* schematically depicts the situation which arises shortly after the start of a reverse clearing operation. During the reverse clearing operation the conveying device 17, the first ammunition magazine 15, the first and second transport devices 3 and 4, the third device 8, the Gatling-type gun 1 and the storage device 10 which is operatively associated with the first conveying device 17, are placed in motion in the opposite direction, as indicated by the arrows. As a result, the cartridges or ammunition rounds 5 are transported back in the direction of the ammunition magazine 15. The switching gate or switch 53 directs empty cases or spent cartridges 11 from the conveying device 17 to the storage device 10. The empty cases or spent cartridges 11 of the ammunition type A are thus no longer transported back by the first transport device 3, the third device 8 and the Gatling-type gun 1, rather are intermediately stored in the storage device 10. The reverse clearing operation is then completed when the Gatling-type gun 1, the first transport device 3 and the third device 8 are free or devoid of non-fired cartridges or ammunition rounds 5 of the ammunition type A. This situation is present when there has been again attained the position depicted in FIG. 4*a*. This final position or firing preparatory position is detected by the previously mentioned sensor or feeler 55. Thereafter, also the switching gate or switch 53 is again switched back into its original position.

Figure 5:
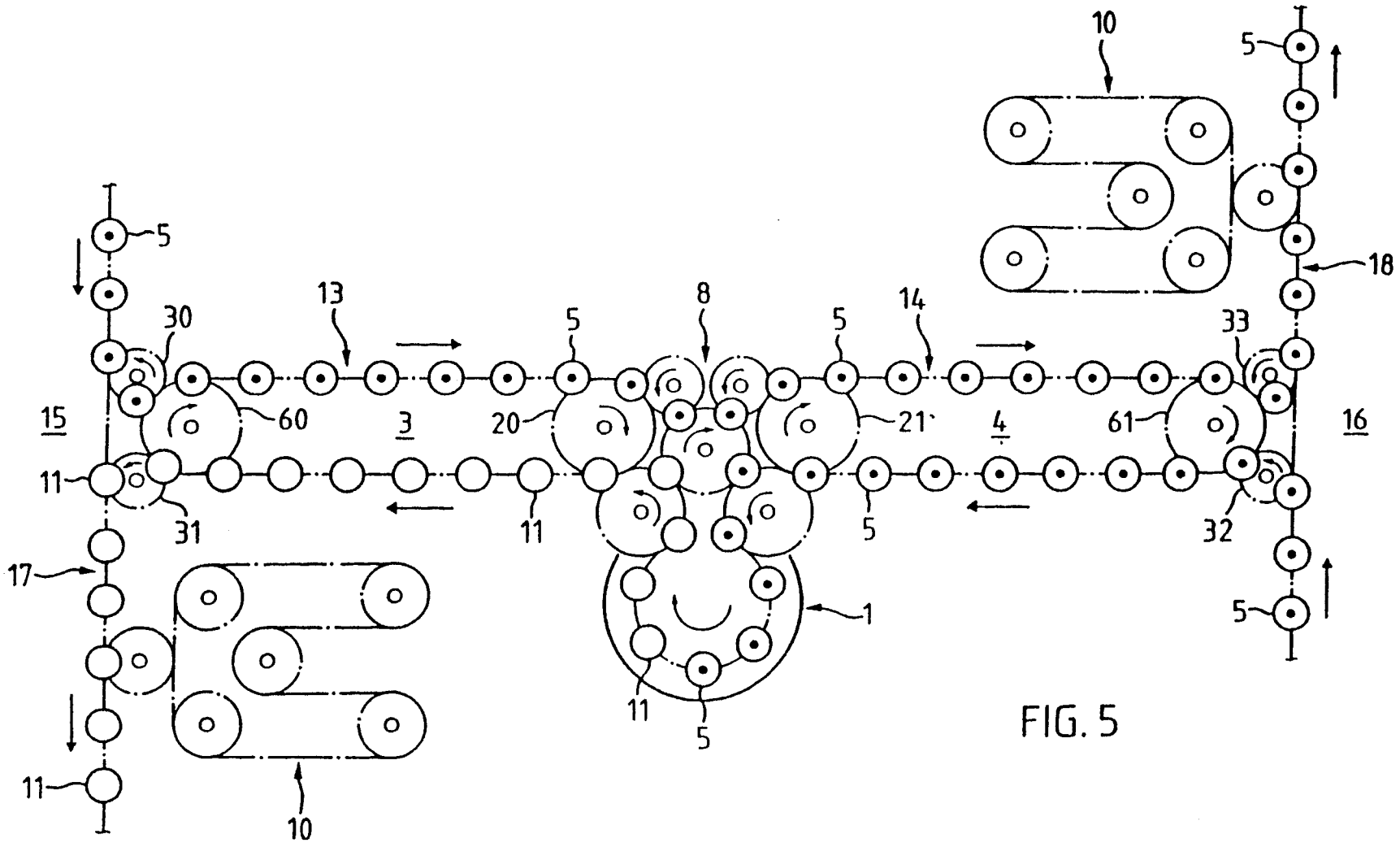
FIG. 5 depicts the function of the inventive double or twin ammunition infeeding apparatus during firing with only one type of ammunition delivered from two ammunition magazines.

FIG. 5 schematically depicts the function of the inventive double or twin ammunition infeeding apparatus during a firing mode using only one type of ammunition delivered from two ammunition magazines. Also in this case it is assumed that firing is accomplished with cartridges or ammunition rounds 5 of the ammunition type A. A notable advantage of this mode of operation resides in the fact that there can be fired cartridges or ammunition rounds from both ammunition magazines or containers without the need to change an ammunition magazine or the like.

Basically during this mode of operation the ammunition magazines 15 and 16, both of the first and second transport device 3 and 4, the third device 8 and the Gatling-type gun 1 are connected together to form an ammunition loop. Thus, cartridges or ammunition rounds 5 are first transported out of the first ammunition magazine 15 by means of the first transport device 3 and via the third device 8 and the second transport device 4 are delivered into the other or second ammunition magazine 16. At the same time cartridges or ammunition rounds 5 are transported from the second ammunition magazine 16 to the second transport device 4 and from that location are delivered by the third device 8 to the Gatling-type gun 1 and there fired. Since both ammunition magazines 15 and 16 constitute transport devices the first ammunition magazine 15 thus replaces the depletion or consumption of the second ammunition magazine 16. Empty cases or spent cartridges 11 are then again conveyed by means of the third device 8 to the first transport device 3 and from that location are transported back into the first ammunition magazine 15. Also in this case the movement directions are conveniently indicated by arrows.

During this operating mode there is only used one of both storage devices 10, namely, in the depicted exemplary embodiment that storage device 10 which is operatively associated with the first conveying device 17 of the first ammunition magazine 15. Just as was the case for the other operating modes, here too the storage device 10 prevents that during reverse clearing empty cases or spent cartridges 11 will be transported by the first and second transport devices 3 and 4, the third device 8 and the Gatling-type gun 1. Thus, also in this case there is ensured that the first fired round of a firing burst will take place after running up to speed of the Gatling-type gun 1 and that there are only delivered empty cases or spent cartridges 11 into the ammunition magazines 15 and 16.

In order to be able to operate all of the inventive double or twin ammunition infeeding apparatuses throughout the heretofore discussed different operating modes, there are required the use of guide devices 27 which correctly convey the cartridges or ammunition rounds 5 and 6 and the empty cases or spent cartridges 11 and 12 into the third device 8. These guide devices 27 and their corresponding positions have been more fully depicted in FIGS. 6, 7 and 8 and will be further considered with reference thereto.

Figure 6:
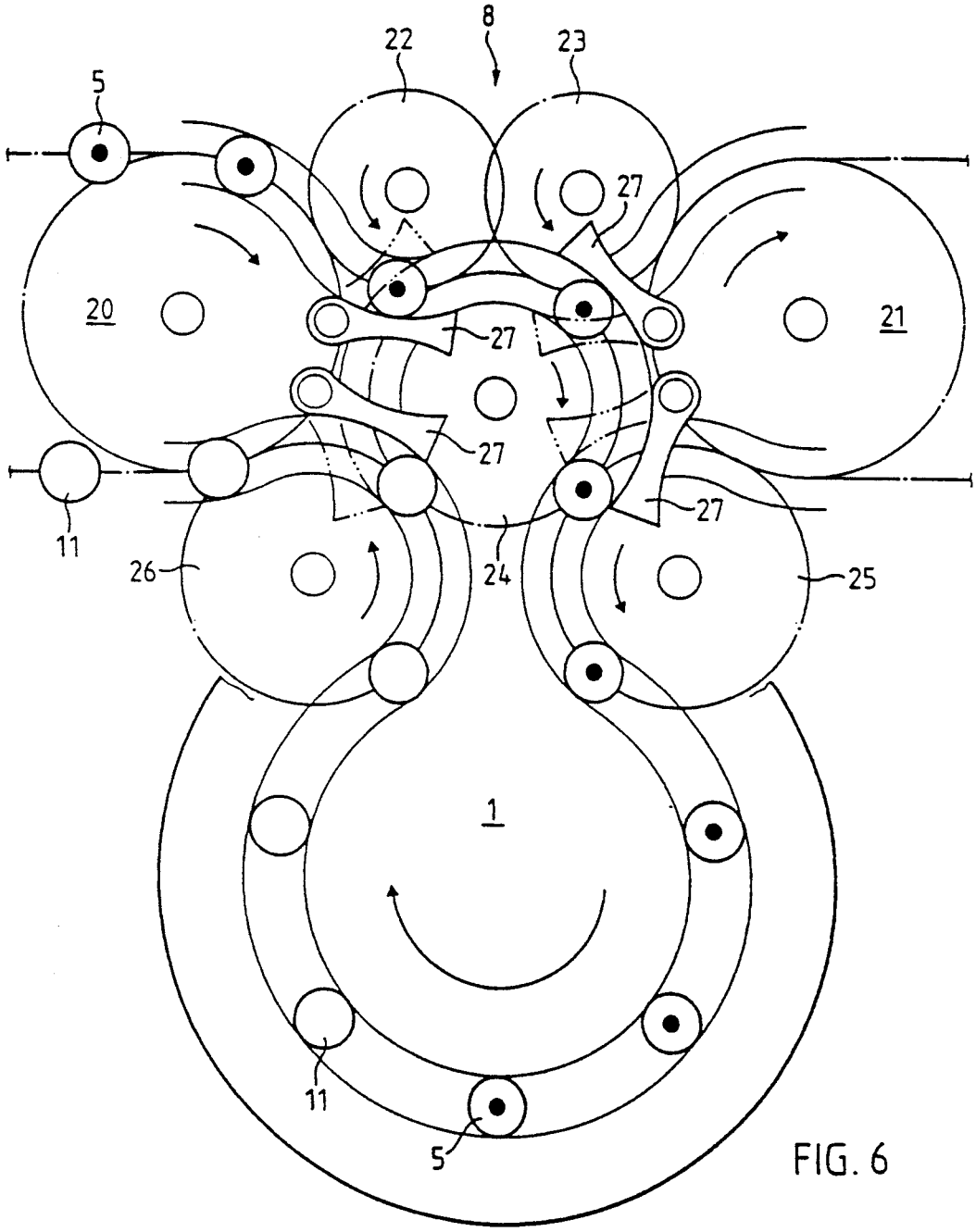
FIG. 6 depicts the guiding of ammunition and the position of the guide devices during firing cartridges of one type of ammunition, conveniently referred to as ammunition type A.

FIG. 6 schematically depicts the guiding of ammunition and the position of the guide devices 27 during firing cartridges 5 of ammunition type A. There are also depicted in such FIG. 6 by arrows the directions of rotation of the deflection or turning wheels 22, 23, 25 and 26 and the central deflection or turning wheel 24.

FIG. 7 schematically depicts the guiding of ammunition and the position of the guide devices 27 during firing cartridges 6 of the ammunition type B. From this FIG. 7 and the depicted directional arrows there also will be apparent that the directions of rotation of the deflection or turning wheels 22, 23, 25 and 26 and the central deflection or turning wheel 24 are the same as during firing cartridges or ammunition rounds 5 of the ammunition type A.

The guide devices 27 are interconnected with one another by not particularly illustrated mechanical control elements in such a manner that the first transported cartridge or ammunition round 5 of the ammunition type A can automatically control the guide devices 27 to assume the position shown in FIG. 6. Equally, the first transported cartridge or ammunition round 6 of the ammunition type B can control the guide devices 27 automatically into the position of FIG. 7. This automatic mechanical control can be always then employed when cartridges or ammunition rounds 5 and 6 of two different types of ammunition are to be fired.

Figure 8:
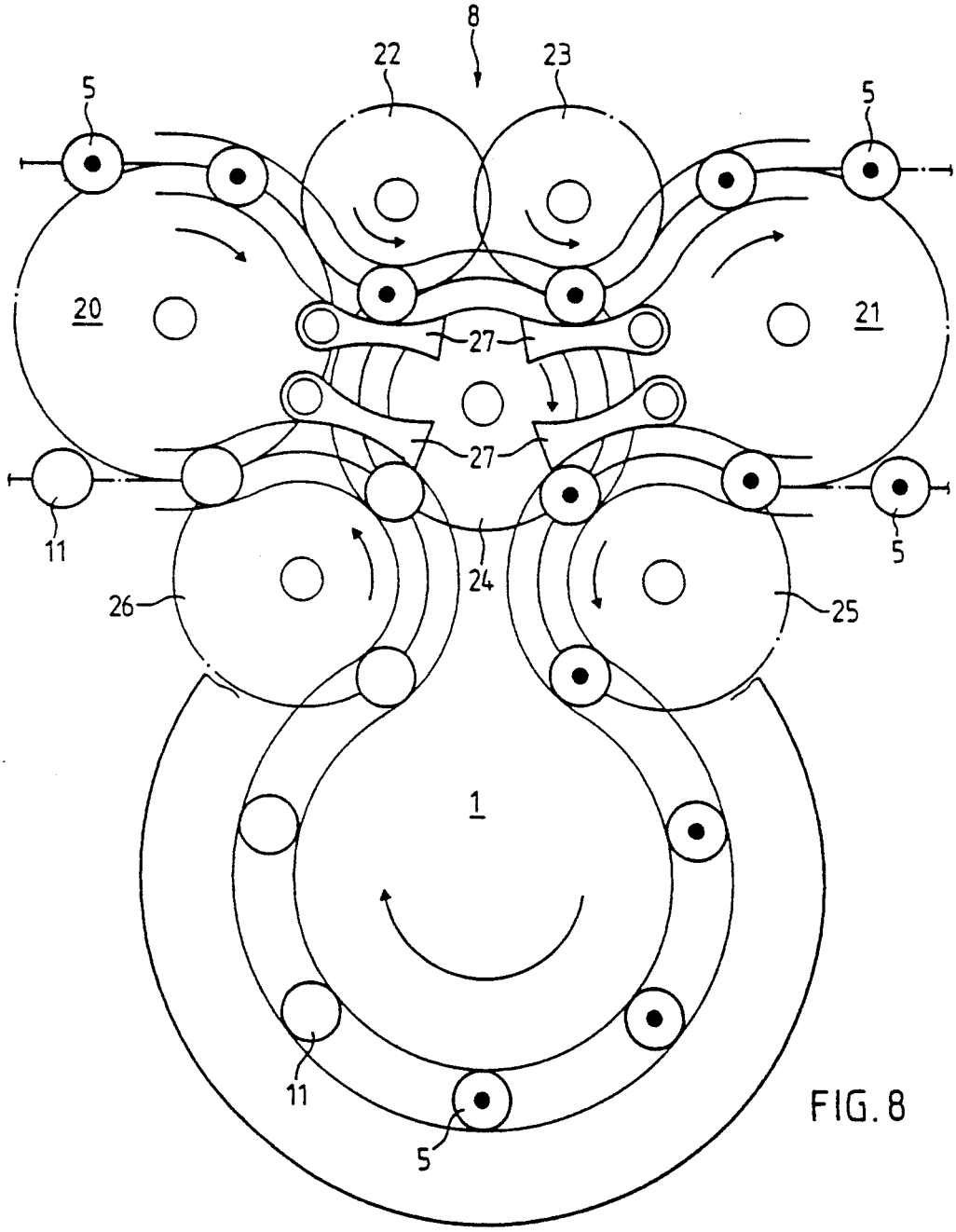
FIG. 8 depicts the guiding of ammunition and the position of the guide devices during firing cartridges of ammunition type A delivered from two ammunition magazines.

FIG. 8 schematically depicts the guiding of ammunition and the position of the guide devices 27 during firing cartridges or ammunition rounds 5 of ammunition type A delivered from two ammunition magazines or the like. Also from this FIG. 8 and the depicted directional arrows there will be seen that the directions of rotation of the deflection or turning wheels 22, 23, 25 and 26, the central deflection or turning wheel 24 and the transport wheels 20 and 21, are the same as during firing cartridges or ammunition rounds 5 or 6 of the ammunition type A or B, respectively (see FIGS. 6 and 7). On the other hand, the guide devices 27 are brought into the position depicted in FIG. 8 by means of further not particularly illustrated mechanical control elements. The previously explained automatic control, as when firing cartridges 5 or 6, can not be here employed.

In the described embodiments the conveying devices 17 and 18 which are operatively associated with the ammunition magazines 15 and 16 are selectively driven via the couplings 40 and 41 or equivalent structure. However, it should be understood that other means or expedients can be conceivably used for the selective driving of the conveying devices 17 and 18, such as, for example, separate drives containing devices for synchronization with the drive source or drive means 7 for the Gatling-type gun 1, the third device 8 as well as the first and second transport devices 3 and 4.

While there are shown and described present preferred embodiments of the invention, it is distinctly to be understood the invention is not limited thereto, but may be otherwise variously embodied and practiced within the scope of the following claims.

What is claimed is:

1. An apparatus for the infeed of cartridges predominantly composed of two different types of ammunition to a Gatling-type gun, comprising:

two ammunition magazines;

a respective conveying device provided for each ammunition magazine of said two ammunition magazines;

a first transport device for the transport of cartridges and empty cases of predominantly a first type of ammunition;

a second transport device for the transport of cartridges and empty cases of predominantly a second type of ammunition;

a third device provided with guide devices and arranged between the first transport device and the second transport device and in coacting relation with the Gatling-type gun for infeeding the cartridges of one ammunition type or the other ammunition type to the Gatling-type gun;

means for simultaneously driving the first transport device, the second transport device and the third device;

a respective storage device operatively associated with a respective one of the conveying devices;

each respective storage device serving for a reception of empty cases from the associated conveying device during reverse clearing following a firing burst, in order to ensure that prior to a new firing burst both the Gatling-type gun, the third device and the first and second transport devices are free of empty cases; and means for selectively driving the conveying devices.

2. The apparatus for the infeed of cartridges according to claim 1, further including:

a respective sensor and a respective switching gate operatively associated with each of the storage devices.

3. The apparatus for the infeed of cartridges according to claim 2, wherein:

the guide devices of the third device comprise switchable guide devices, in order to operatively interconnect the first and second transport devices and the third device, so that only cartridges of a single ammunition type can be delivered to the Gatling-type gun.

4. The apparatus for the infeed of cartridges according to claim 1, wherein:

each said first transport device and said second transport device comprise a respective endless transport device.

5. An apparatus for the infeed of cartridges predominantly composed of two different types of ammunition to a Gatling-type gun, comprising:

a first ammunition magazine;

a second ammunition magazine;

a first conveying device provided for the first ammunition magazine;

a second conveying device provided for the second ammunition magazine;

a first transport device for the transport of cartridges and empty cases of predominantly a first type of ammunition cooperating with the first conveying device;

a second transport device for the transport of cartridges and empty cases of predominantly a second type of ammunition cooperating with the second conveying device;

a third device provided with guide means and arranged between the first transport device and the second transport device and in coacting relation with the Gatling-type gun for infeeding the cartridges of one of a first type of ammunition and a second type of ammunition to the Gatling-type gun;

means for simultaneously driving the first transport device, the second transport device and the third device;

a first storage device operatively associated with the first conveying device;

a second storage device operatively associated with the second conveying device;

each of the first and second storage devices serving for a reception of empty cases from the respective first and second conveying devices during reverse clearing following a firing burst, in order to ensure that prior to a new firing burst both the Gatling-type gun, the third device and the first and second transport devices are free of empty cases; and means for selectively operating the first and second conveying devices.

* * * * *